US005431392A

United States Patent [19]

Carson et al.

[11] Patent Number: 5,431,392

[45] Date of Patent: Jul. 11, 1995

[54] TEE OFF GOLF TEES

[76] Inventors: Dee L. Carson, 173 Wolcott St., Bristol, Conn. 06010; George Spector, 233 Broadway, Rm. 702, New York, N.Y. 10279

[21] Appl. No.: 239,920

[22] Filed: May 9, 1994

[51] Int. Cl.[6] ..... A63B 57/00

[52] U.S. Cl. ..... 273/33

[58] Field of Search ..... 273/33, 202–212

[56] References Cited

U.S. PATENT DOCUMENTS

| | | | |
|---|---|---|---|
| 3,954,263 | 5/1976 | Whelan et al. | 273/33 |
| 4,014,541 | 3/1977 | Desmarais | 273/33 |
| 4,909,508 | 3/1990 | Noland et al. | 273/33 |
| 5,046,730 | 9/1991 | Golden et al. | 273/33 |
| 5,082,264 | 1/1992 | Takeno | 273/33 |
| 5,085,438 | 1/1992 | Takeno | 273/33 |

FOREIGN PATENT DOCUMENTS

| | | | |
|---|---|---|---|
| 4097764 | 3/1992 | Japan | 273/33 |
| 2209953 | 6/1989 | United Kingdom | 273/33 |

*Primary Examiner*—Vincent Millin
*Assistant Examiner*—Steven B. Wang

[57] ABSTRACT

A decomposable organic golf tee is provided, that is made of a compacted mulch material and water soluble adhesive, so that when inserted into the ground it will decompose after awhile to blend into the surrounding terrain. A modified decomposable organic golf tee is also provided, that contains a biodegradable support wall, plant food with grass seeds and a pair of wedges within, to help break up the tee when a downward force is applied thereto, so as to promote the growth of grass.

1 Claim, 1 Drawing Sheet

TEE OFF GOLF TEES

BACKGROUND OF THE INVENTION

The instant invention relates generally to golf tees and more specifically it relates to a decomposable organic golf tee, which provides a solid structure made of compacted mulch material and water soluble adhesive that will decompose in the ground.

There are available various conventional golf tees which do not provide the novel improvements of the invention herein disclosed.

SUMMARY OF THE INVENTION

A primary object of the present invention is to provide a decomposable organic golf tee that will overcome the shortcomings of the prior art devices.

Another object is to provide a decomposable organic golf tee that is made of a compacted mulch material and water soluble adhesive, so that when inserted into the ground it will decompose after awhile to blend into the surrounding terrain.

An additional object is to provide a decomposable organic golf tee that contains a biodegradable support wall, plant food with grass seeds and a pair of wedges within, to help break up the tee when a downward force is applied thereto, so as to promote the growth of grass.

A further object is to provide a decomposable organic golf tee that is simple and easy to use.

A still further object is to provide a decomposable organic golf tee that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
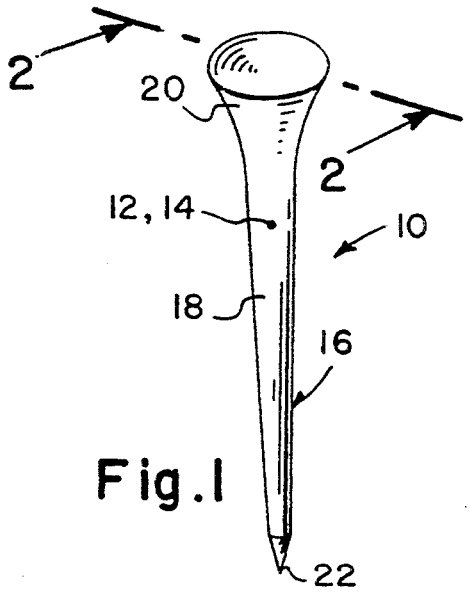
FIG. 1 is a perspective view of the invention.
Figure 2:
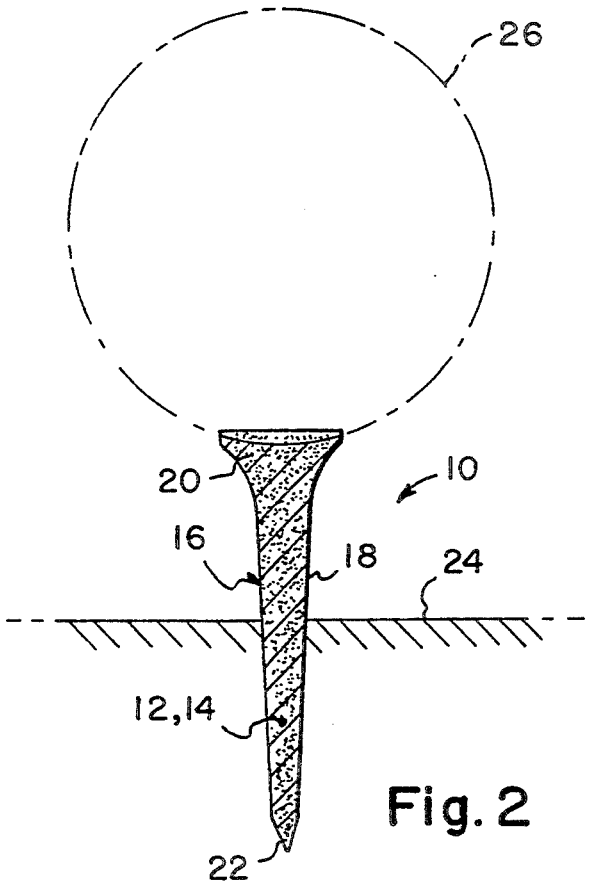
FIG. 2 is a cross sectional view taken along line 2—2 in FIG. 1, showing the internal composition being compacted mulch material and water soluble adhesive.

Turning now descriptively to the drawings, in which similar reference characters denote similar elements throughout the several views, FIGS. 1 and 2 illustrate a decomposable organic golf tee 10, which consists of mulch material 12. A water soluble adhesive 14 is combined and compacted with the mulch material 12 to form a solid structure 16 having a tapered body 18, a concave head 20 and a pointed tip 22. When the pointed tip 22 is inserted into the ground 24, the concave head 20 on the tapered body 18 will support a golf ball 26. If the tee 10 is left inserted in the ground 24, it will decompose after a short period of time, to blend into the surrounding terrain. The mulch material 12 is made of pulverized straw, leaves, twigs and earth that are mixed together.

Figure 3:
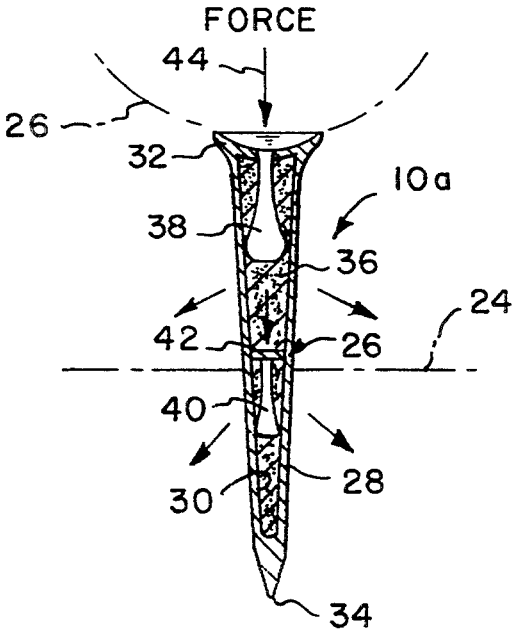
FIG. 3 is a cross sectional view of a modification having plant food and grass seeds with a pair of wedges therein, to quickly help break up the tee when a downward force is received thereon.

A modified decomposable organic golf tee 10a, as shown in FIG. 3, which contains a biodegradable support wall 26 having a tapered body 28 with a chamber 30 therein, a concave head 32 and a pointed tip 34. A mixture of plant food and grass seeds 36 is carried within the chamber 30 of the tapered body 28. When the pointed tip 34 is inserted into the ground 24, the concave head 32 on the tapered body 28 will support a golf ball 26. If the tee 10*a* is left inserted in the ground 24, the support wall 28 will decompose after a short period of time, to release the mixture of plant food and grass seed 36 from the chamber 30 to promote the growth of grass.

The modified decomposable organic golf tee 10*a* further includes a pair of wedges 38 and 40. The first wedge 38 is suspended from the concave head 32 within the chamber 30. The second wedge 40 is suspended from a transverse base 42 approximately midway within the chamber 30. When a downward force 44 is received on the concave head 32 by a golf club hitting the golf ball 26, the first wedge 38 and the second wedge 40 will quickly help break up the tapered body 28 of the support wall 26, to release the mixture of plant food and grass seed 36.

OPERATION OF THE INVENTION

To use the decomposable organic golf tee 10 a person simply presses the pointed tip 22 into the ground 24. The golf ball 26 is then placed onto the concave head 20. If the tee 10 is left in the ground 24, it will decompose after a short period of time.

To use the organic golf tee 10*a*, the person simply presses the pointed tip 34 into the ground 24. The golf ball 26 is then placed onto the concave head 32. If the tee 10*a* is left in the ground 24, it will decompose after a short period of time to release the mixture of plant food and grass seeds 36. If a golf club places the downward force 44 on the golf ball 26, the first and second wedges 38 will quickly brake up the tapered body 28 of the support wall 26, to release the mixture of plant food and grass seeds 36.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A decomposable organic golf tee which comprises:

a) a biodegradable support wall having a tapered body with a chamber therein, a concave head and a pointed tip and b) a mixture of plant food and grass seeds carried within said chamber of said tapered body, so that when said pointed tip is inserted into the ground said concave head on said tapered body will support a golf ball and if left inserted in the ground, said support wall will decompose after a short period of time to release said mixture of plant food and grass seed from said chamber, to promote the growth of grass; further including a pair of wedges in which said first wedge is suspended from said concave head within said chamber and said second wedge is suspended from a transverse base approximately midway within said chamber, so that when a downward force is received on said concave head by a golf club hitting the golf ball, said first wedge and said second wedge will quickly help break up said tapered body of said support wall to release said mixture of plant food and grass seeds.

* * * * *